US011018443B2

(12) United States Patent
Fang et al.

(10) Patent No.: US 11,018,443 B2
(45) Date of Patent: May 25, 2021

(54) COUPLER BETWEEN A COAXIAL CONNECTOR AND A COAXIAL CABLE

(71) Applicant: Rosenberger Hochfrequenztechnik GmbH & Co. KG, Fridolfing (DE)

(72) Inventors: Rong Fang, Freilassing (DE); Josef Peteranderl, Grabenstätt (DE); Sabine Krautenbacher, Tittmoning (DE)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 0 days.

(21) Appl. No.: 16/313,532

(22) PCT Filed: May 23, 2017

(86) PCT No.: PCT/EP2017/000613
§ 371 (c)(1),
(2) Date: Dec. 27, 2018

(87) PCT Pub. No.: WO2018/014986
PCT Pub. Date: Jan. 25, 2018

(65) Prior Publication Data

US 2019/0252805 A1 Aug. 15, 2019

(30) Foreign Application Priority Data

Jul. 22, 2016 (DE) ..... 102016008903.2

(51) Int. Cl.
*H01R 9/05* (2006.01)
*H01R 4/00* (2006.01)
(Continued)

(52) U.S. Cl.
CPC ..... *H01R 9/05* (2013.01); *H01R 4/54* (2013.01); *H01R 9/0524* (2013.01);
(Continued)

(58) Field of Classification Search
CPC ..... H01R 9/0524; H01R 13/622; H01R 9/05; H01R 9/0521; H01R 24/38; H01R 9/0518; H01R 13/625; H01R 4/54
(Continued)

(56) References Cited

U.S. PATENT DOCUMENTS 3,133,776 A 5/1964 Magers et al.
3,332,052 A 7/1967 Rusinyak
(Continued)

FOREIGN PATENT DOCUMENTS

CN 1219657 A 6/1999
CN 1938907 A 3/2007
(Continued)

*Primary Examiner* — Abdullah A Riyami
*Assistant Examiner* — Justin M Kratt
(74) *Attorney, Agent, or Firm* — David P. Dickerson

(57) ABSTRACT

A coupler (100; 100') between a first coaxial connector and a coaxial cable (10) has a first coaxial connector with an inner conductor (2), at least one hollow cylindrical insulator part (27; 271, 272) and a hollow cylindrical outer conductor (1) and a first spring sleeve (9) for accommodating an outer conductor (11) of the coaxial cable (10), which spring sleeve is connected to the outer conductor (1) of the first coaxial connector. In addition, the coupler (100; 100') in accordance with the invention has a locking device, which is axially movable relative to a longitudinal axis of the first coaxial connector and is supported on a conically realized outer surface (20) at a distal end of the first spring sleeve (9). The outer conductor (1) of the first coaxial connector is connected to the locking device via a bayonet connection.

21 Claims, 5 Drawing Sheets

(51) Int. Cl.
*H01R 13/625* (2006.01)
*H01R 13/622* (2006.01)
*H01R 24/38* (2011.01)

(52) U.S. Cl.
CPC ..... *H01R 13/625* (2013.01); *H01R 9/0518* (2013.01); *H01R 9/0521* (2013.01); *H01R 13/622* (2013.01); *H01R 24/38* (2013.01)

(58) Field of Classification Search
USPC ..... 439/332, 578–585, 607.41, 607.42
See application file for complete search history.

(56) References Cited

U.S. PATENT DOCUMENTS 5,052,946 A 10/1991 Homolka
6,089,913 A * 7/2000 Holliday ..... B25B 27/10 439/462
6,709,290 B2 * 3/2004 Yoshida ..... H01R 9/0518 439/585
6,783,394 B1 * 8/2004 Holliday ..... H01R 9/0518 439/578
2007/0042640 A1 * 2/2007 Rosenberger ..... H01R 13/6277 439/578
2009/0111323 A1 4/2009 Burris et al.
2012/0003869 A1 * 1/2012 Ehret ..... H01R 24/40 439/578
2012/0252267 A1 * 10/2012 Nugent ..... H01R 24/545 439/582
2013/0078856 A1 * 3/2013 Blew ..... H01R 24/40 439/578

FOREIGN PATENT DOCUMENTS

CN 101886725 A 11/2010
DE 2122305 A1 1/1972
DE 2212817 A1 9/1973
DE 10048507 C1 3/2002
DE 202004016541 U1 2/2005
EP 1049198 A2 11/2000
EP 2202852 A2 12/2009

* cited by examiner

COUPLER BETWEEN A COAXIAL CONNECTOR AND A COAXIAL CABLE

FIELD OF THE INVENTION

The invention relates to a coupler between a coaxial connector and a coaxial cable.

BACKGROUND OF THE INVENTION

In the testing of coaxial cables, leakage parameters of the coaxial cable are typically measured by means of a vectorial network analyzer. Other important characteristics of the coaxial cable such as, for example, the standing wave ratio, or intermodulations occurring in the coaxial cable, are determined from the measured leakage parameters.

The test system also comprises, besides the vectorial network analyzer, a high-frequency measurement cable, a coupler and the coaxial cable to be tested. The high-frequency measurement cable is connected, on the one hand, to an interface of the vectorial network analyzer, and on the other hand to a coaxial connector. This coaxial connector, in the following referred to as a second coaxial connector, together with a further coaxial connector, which belongs to the coupler and which in the following is referred to as a first coaxial connector, forms a coaxial plug-and-socket connector. The coupler connects the coaxial cable to be tested to the first coaxial connector.

A coupler that connects a coaxial cable to a coaxial connector is disclosed by DE 000002212817 A. The connection of the coaxial cable to the coupler in this case is effected in that the spread outer conductor of the coaxial cable is pressed, by the conical clamping surface of a sleeve part screwed onto the coupler, against an outer surface of a clamping sleeve of the coupler, which outer surface serves as a further clamping surface.

The clamping of the outer conductor of the coaxial cable between the two clamping surfaces of the sleeve part and the clamping sleeve has the result that, with each operation of locking a coaxial cable into the coupler, in each case typically there is a different volume of the outer conductor braid present between the two clamping surfaces. The length over which the sleeve part is screwed onto the coupler thus differs with each locking operation.

Disadvantageously, therefore, the distance between the two clamping surfaces, and the clamping force acting between the two clamping surfaces upon the clamped-in outer conductor braid, are not reproducible. In addition, owing to the respectively differing outer conductor braid between the two clamping surfaces, the impedance transition between the coaxial cable and the coupler also differs with each locking operation, and is therefore disadvantageously not reproducible.

It is therefore the object of the invention to create a coupler, between a coaxial cable and a coaxial connector, that has improved properties.

BRIEF SUMMARY OF THE INVENTION

The aforementioned object is addressed by the embodiments recited in the independent claims. Further embodiments are recited in the dependent claims.

In an embodiment in accordance with the present disclosure, the coupler has a spring sleeve, which receives the outer conductor of the coaxial cable. In the following, the spring sleeve is referred to as the first spring sleeve. The spring sleeve is connected to the outer conductor of the first coaxial connector. For the purpose of clamping the outer conductor in the first spring sleeve, the coupler has a locking device. This locking device is supported on a conically realized outer surface at the distal end of the first spring sleeve, and is axially movable relative to the longitudinal axis of the first coaxial connector. The locking device is additionally connected to the outer conductor of the first coaxial connector via a bayonet connection.

In the following, a locking device is understood to mean a device, in particular composed of a plurality of interconnected components, that exerts a radial force upon the first spring sleeve, and thereby an outer conductor of a coaxial cable inserted in the inside of the first spring sleeve is pressed in a force-fitting manner onto the inner cylindrical surface of the first spring sleeve and is thus fixed to the first spring sleeve with force-fitting engagement.

As a result of the locking device being moved axially, via the bayonet connection, in the direction of the first coaxial connector, it is supported along the conically realized outer surface of the first spring sleeve and thereby compresses the first spring sleeve increasingly strongly in the radial direction, with the result that an increasingly stronger clamping of the outer conductor of the coaxial cable within the first spring sleeve is effected.

Since the bayonet connection determines a defined and reproducible length for the axial movement of the locking device, the supporting of the locking device on the first spring sleeve advantageously causes a defined and reproducible compression force to be exerted by the first spring sleeve upon the outer conductor of the coaxial cable as soon as the locking device has been moved, via the bayonet connection, to the maximum possible extent axially in the direction of the first coaxial connector. At the end of this maximum possible axial movement of the locking device in the direction of the first coaxial connector, the coaxial cable is fixed with the defined compression force in the coupler.

Preferably, the first spring sleeve has a radially inwardly directed ridge, which serves as an axial stop for the outer conductor of the coaxial cable. It is thereby ensured that a defined and reproducible outer-conductor surface of the coaxial cable is in contact with the first spring sleeve. In combination with the defined and reproducible compression force by the first spring sleeve upon the outer conductor of the coaxial cable, a defined and reproducible impedance transition, from the coaxial cable to the first coaxial connector, can advantageously be realized.

In a first embodiment in accordance with the present disclosure, the bayonet connection is realized by at least one elongate bore, which extends in the form of a helix in a first sleeve-type component belonging to the locking device, and an associated guide pin, which is fastened in the outer conductor of the first coaxial connector and guided in the elongate bore. The axial extent of the elongate bore defines the length of the axial movement capability of the locking device. Since the position of the elongate bore within the first sleeve-type component is exactly defined, the course of the axial movement of the locking device relative to the conically realized outer surface of the first spring sleeve, and thus the magnitude of the compression force exerted by the locking device upon the first spring sleeve during the axial movement of the locking device, are thus also exactly defined.

In a second embodiment in accordance with the present disclosure, the bayonet connection is realized by at least one elongate bore, which extends in the form of a helix in the outer conductor of the first coaxial connector, and by an associated guide pin, which is fastened in a first sleeve-type component, belonging to the locking device, and guided in the elongate bore. In this case, also, the axial extent of the elongate bore defines the length of the axial movement capability of the locking device. With regard to the course of the axial movement of the locking device relative to the conically realized outer surface of the first spring sleeve and the magnitude of the compression force exerted by the locking device upon the first spring sleeve, the statements made above concerning the first embodiment apply analogously to the second embodiment.

With the coaxial fixing of the coaxial cable to the first coaxial connector at the end of the axial movement of the locking device relative to the outer conductor of the first coaxial connector, there is a sufficient portion of the bare inner conductor of the coaxial cable inserted and fixed in a spring sleeve attached to the end of the inner conductor of the first coaxial connector, which spring sleeve is referred to in the following as a second spring sleeve.

There is preferably a spring clamped-in between an end face, referred to in the following as a first end face, provided on a step of the outer conductor of the first coaxial connector, and an opposite end face of the first sleeve-type component, which in the following is referred to as a second end face. The compression force of the spring enables the guide pin to be positioned in a fixed manner in the elongate bore, or in the groove, and thus enables the locking device to be positioned in a fixed manner relative to the conically realized outer surface of the first spring sleeve.

The locking device preferably comprises a second sleeve-type component, which falls on the conically realized outer surface of the first spring sleeve, and which is axially adjustable in relation to the rest of the locking device. Inaccuracies in the external diameter of the outer conductor of the coaxial cable that are due to the production process can thereby be compensated, and consequently an identical compression force can always be exerted by the locking device, via the first spring sleeve, upon the outer conductor of the coaxial cable, irrespective of the external diameter of the outer conductor of the coaxial cable.

The axial adjustment of the second sleeve-type component in relation to the other components of the locking device is effected by screwing an external thread, located on the outer surface of the second sleeve-type component, into an associated internal thread of a third sleeve-type component belonging to the locking device.

The axial fixing of the second sleeve-type component relative to the third sleeve-type component, and thus in relation to the other components of the locking device, is preferably effected by means of a nut, which is screwed-on on the external thread of the second sleeve-type component and locked against an end face of the third sleeve-type component.

The second sleeve-type component is preferably supported, by its rounded edge between its inner surface, in particular its inner cylindrical surface, and its end face, on the conically realized outer surface of the first spring sleeve. The rounded edge advantageously enables the second sleeve-type component to slide more easily axially along the conically realized outer surface of the first spring sleeve.

Whereas the first sleeve-type component belonging to the locking device, upon the axial displacement in relation to the outer conductor of the first coaxial connector, also undergoes a radial movement in relation to the first coaxial connector because of the bayonet connection, the second sleeve-type component, and therefore also the third sleeve-type component of the locking device, are to be fixed radially relative to the first spring sleeve, which is connected to the outer conductor of the first coaxial connector. Provided for this purpose is at least one fixing component, which is mounted, on the one hand, in an associated recess of the third sleeve-type component and, on the other hand, in an associated recess in a radial extension of the first spring sleeve.

Whereas the axial driving of the second sleeve-type component in relation to the third sleeve-type component is effected by means of the locked screwed connection between the second and the third sleeve-type component, the axial driving of the third sleeve-type component in relation to the first sleeve-type component is preferably realized by means of a radial extension of the first sleeve-type component and an associated radial extension of the third sleeve-type component.

An annular component is preferably to be inserted between the radial extensions of the first and the third sleeve-type component of the locking device. The coefficient of sliding friction of the annular component is less than a previously defined threshold value. In this way, advantageously, the rotatory movement of the first sleeve-type component in relation to the rotatorily fixed third sleeve-type component is very smooth. Moreover, the abrasion, over time, at the two radial extensions of the first and the third sleeve-type component is thereby reduced.

In order for the axial displacement of the locking device relative to the outer conductor of the first coaxial connector to be effected by means of the bayonet connection, and thus for the clamping of the coaxial cable into the coupler to be effected in a manner that, for the user, requires as little force as possible, there is at least one grip, which is preferably realized in the form of a pin, inserted in an associated bore in the first sleeve-type component of the locking device.

BRIEF DESCRIPTION OF THE DRAWINGS

The coupler in accordance with the invention is explained in detail in the following, with its embodiments and variants, on the basis of the drawing. The figures of the drawing show.

DETAILED DESCRIPTION OF THE INVENTION

The first embodiment 100 of the coupler in accordance with the invention is described in detail in the following on the basis of FIGS. 1A, 1B and 1C:

The coupler 100 has a first coaxial connector, which is constructed according to a coaxial plug-and-socket connector standard suitable for high-frequency signals, for example according to the Threaded Neill-Concelman (TNC) standard.

This first coaxial connector comprises a substantially hollow cylindrical outer conductor 1, an inner conductor 2, which is arranged so as to be coaxial with the outer conductor 1 and which is substantially cylindrical, and at least one insulator part $\mathbf{3}_1$ and $\mathbf{3}_2$, which adjoins, respectively, the inner cylindrical surface of the outer conductor 1 and the outer cylindrical surface of the inner conductor 2, and which is substantially in the form of a hollow cylinder.

Instead of two insulator parts $\mathbf{3}_1$ and $\mathbf{3}_2$, there may also be provided a single insulator part, which fills the entire space between the inner cylindrical surface of the outer conductor 1 and the outer cylindrical surface of the inner conductor 2, or a greater number of insulator parts, which fill the space between an axially extending inner cylindrical surface of the outer conductor 1 and an axially extending outer cylindrical surface of the inner conductor 2.

Figure 1A:
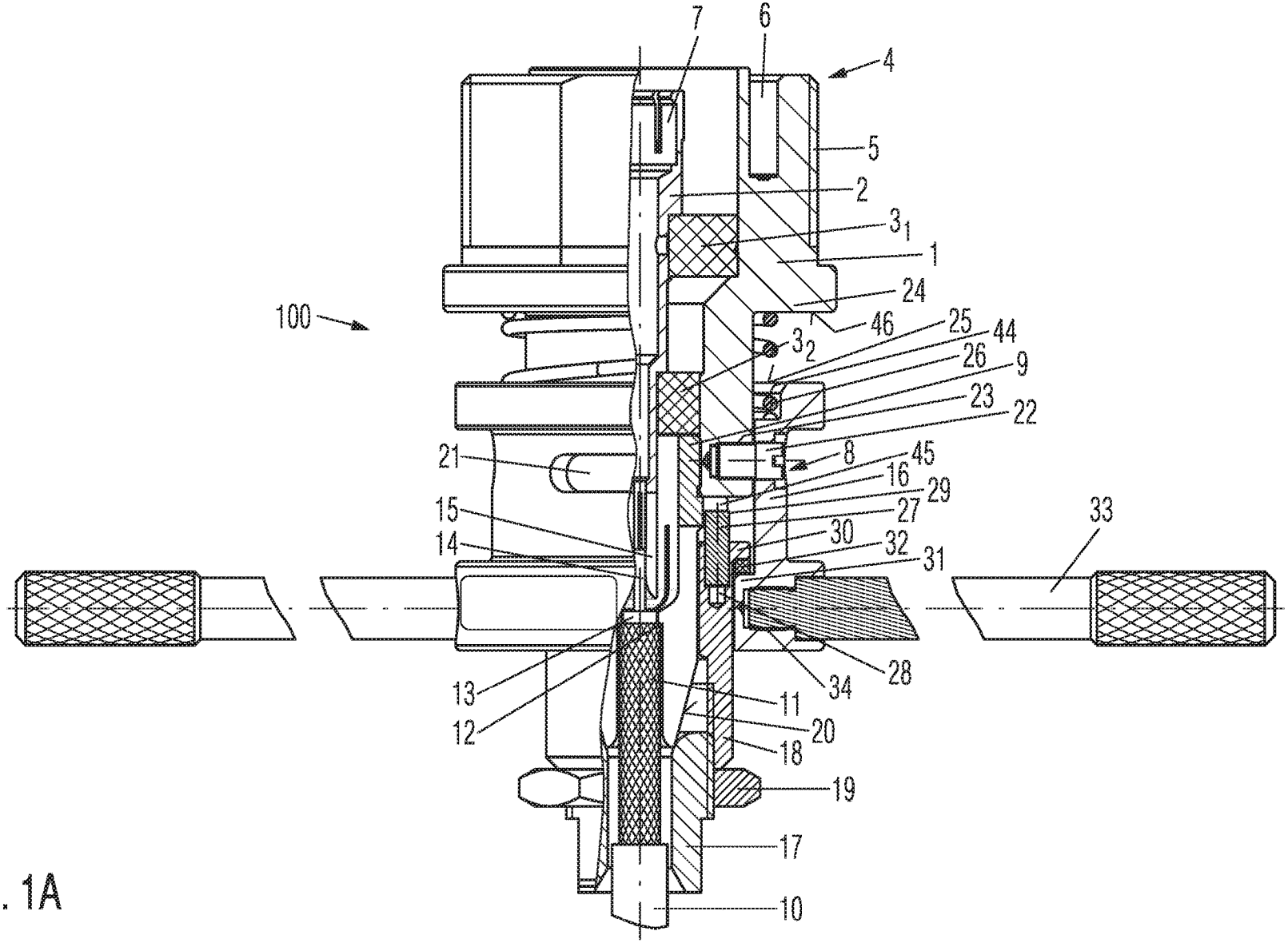
FIG. 1A a combined representation of a side view and an axial cross section of a first embodiment of the coupler in accordance with the invention with axially non-fixed coaxial cables, FIG. 1B a representation of an axial cross section of a first embodiment of the coupler in accordance with the invention with axially fixed coaxial cables, FIG. 1C a representation of a radial cross section of the coupler in accordance with the invention with axially fixed coaxial cables, FIG. 2A a combined representation of a side view and an axial cross section of an axial cross section of a second embodiment of the coupler in accordance with the invention, FIG. 2B an exploded representation of a second embodiment of the coupler in accordance with the invention, and FIG. 3 a combined representation of a side view and an axial cross section of the coupler in accordance with the invention with connected coaxial cable and connected measurement cable.

As shown by FIG. 1A, the first coaxial connector, at its first axial end 4, which represents the interface to the second coaxial connector, on the outer cylindrical surface of its outer conductor 1, has an external thread 6. This external thread 6 corresponds to an internal thread of a cap nut belonging to the second coaxial connector. The first coaxial connector and the second coaxial connector consequently form a coaxial plug-and-socket connector by means of screwed connection. However, the invention also covers a coaxial plug-and-socket connector formed by means of latching connection, a so-called coaxial plug-and-socket latching connector.

As explained in greater detail further below, the outer conductor 1 of the first coaxial connector has, at its first axial end 4, a hollow cylindrical groove 6, into which a corresponding cylindrical sleeve of the outer conductor belonging to the second coaxial connector is inserted in a force-fitting manner when the coaxial plug-and-socket connector is in the connected state. The inner conductor 2 of the first coaxial connector is realized, at the first axial end 4 of the first coaxial connector, as a spring sleeve 7, which in the following is referred to as a third spring sleeve 7, and accommodates a substantially cylindrical inner conductor of the second coaxial connector in a force-fitting and/or form-fitting manner.

A spring sleeve is understood to mean a substantially sleeve-type body that, at its distal end, has a plurality of slots that each extend in the longitudinal axial direction and are mutually spaced apart in respectively equidistant angular segments. A spring shackle is realized between each two adjacent slots. Each spring shackle may optionally have, at its end, an extension that is directed radially inward or outward and that serves as a contact element.

A spring sleeve 9, referred to as a first spring sleeve, is press-fitted on the inner cylindrical surface at the second axial end 8 of the outer conductor 1, and thus connected in a force-fitting manner to the first coaxial connector. For the purpose of axially fixing the first spring sleeve 9 in the outer conductor 1 of the first coaxial connector, the first spring sleeve 9 preferably has a radially outwardly directed extension that comes against the end face at the second end 8 of the first coaxial connector.

This first spring sleeve 9 accommodates the coaxial cable 10 to be measured, and establishes an electrical connection between the outer conductor 1 of the first coaxial connector and the shielding of the coaxial cable 10 serving as an outer conductor 11 of the coaxial cable 10.

For this purpose, the coaxial cable 10 to be measured is freed from its cable sheath, at its end, over a sufficient length, such that the shielding serving as an outer conductor 11 of the coaxial cable 10 is exposed over this sufficient length. The mechanical connection and the electrical contacting between the first spring sleeve 9 and the shielding, serving as the outer conductor 11 of the coaxial cable 10, are effected in that the coaxial cable 10 is inserted into the first spring sleeve 9 until the end face of the exposed shielding, serving as an outer conductor 11 of the coaxial cable 10, comes axially against a radially inwardly directed ridge 12 of the first spring sleeve 9. A portion of spring sleeve 9 that contacts the exposed shielding of the coaxial cable 10 may be designated a contact portion.

The radially inwardly directed ridge 12 is positioned axially within the first spring sleeve 9 in such a manner that a sufficient region of the shielding, serving as an outer conductor 11 of the coaxial cable 10, bears against the inner cylindrical surface of the first spring sleeve 9. It is thereby ensured that the transfer impedance between the shielding, serving as an outer conductor 11 of the coaxial cable 10, and the first spring sleeve 9 of the coupler 100 is within a suitable value range. The ridge 12 is additionally positioned axially within the first spring sleeve 9 in such a manner that there is a sufficient distance between the ridge 12 of the first spring sleeve 9 and the second end, configured as a second spring sleeve 15, of the inner conductor 2 belonging to the first coaxial connector.

In order additionally to guide the coaxial cable 10 in the first spring sleeve 9, the insulator part 13 of the coaxial cable 10 is exposed over a certain length with respect to the shielding, serving as an outer conductor 11 of the coaxial cable 10, and contacts the inner cylindrical surface of the radially inwardly directed ridge 12. The insulator part 13 of the coaxial cable 10 is preferably exposed over the axial length of the inner cylindrical surface of the ridge 12 with respect to the shielding, as represented in FIG. 1A.

Finally, the inner conductor 14 of the coaxial cable 10 is exposed over such a length with respect to the insulator part 13 that it bears directly against the inner cylindrical surface of the second spring sleeve 15 of the inner conductor 2, both in the case of a coaxial cable 10 fixed into the coupler 100 and in the case of a coaxial cable 10 inserted, and not yet fixed, into the coupler 100.

In order to insert the coaxial cable 10 as easily as possible into the first spring sleeve 9, the inner surface, preferably the inner cylindrical surface, of the first spring sleeve 9 is realized such that it is conical at the distal end, or rounded in relation to the end face of the first spring sleeve 9.

The mechanical fixing of the coaxial cable 10 in the coupler 100 is effected by a locking device. This locking device comprises a first sleeve-type component 16, a second sleeve-type component 17, a third sleeve-type component 18 and a nut 19.

In the mechanical fixing of the coaxial cable 10, this locking device is moved axially, over a defined length, along the longitudinal axis of the coupler 100, in the direction of the first end 4 of the first coaxial connector. As its axial movement progresses, the locking device, which is supported on the conically realized outer surface 20 at the distal end of the first spring sleeve 9, in particular on the conically realized outer cylindrical surface 20 at the distal end of the first spring sleeve 9, causes the elastic first spring sleeve 9 to be subjected to ever greater radially inward compression. The radially inwardly directed compression force of the elastic first spring sleeve 9 is transmitted to the shielding that is arranged within the first spring sleeve 9 and that serves as an outer conductor 11 of the coaxial cable 10, and enables the coaxial cable 10 to be mechanically fixed in an adequate manner in the coupler 100. The adequate mechanical fixing also ensures a sufficient electrical contact between the shielding, serving as an outer conductor 11 of the coaxial cable 10, and the first spring sleeve 9 of the coupler 100.

The defined length of the axial movement of the locking device is determined by the axial length of at least one elongate bore 21, which in each case is provided in the first sleeve-type component 16 of the locking device. The defined length of the axial movement of the locking device determines a defined compression force by the first spring sleeve 9 upon the shielding, serving as an outer conductor 11 of the coaxial cable 10, and thus a specific mechanical stability between the coaxial cable 10 and the coupler 100 when the coaxial cable 10 is in the state of having been fixed in the coupler 100.

Preferably, two elongate bores 21 are provided in the first sleeve-type component 16. In divergence therefrom, any other technically appropriate number of elongate bores 21 may also be realized in the first sleeve-type component 16, and is also covered by the invention. The axial lengths of the individual elongate bores 21 are consistently identical.

The diameter of the inner cylindrical surface of the first sleeve-type component 16 corresponds to the diameter of the outer cylindrical surface of the first coaxial connector at its second end, such that the first sleeve-type component 16 of the locking device can slide over the first coaxial connector.

Guided in each elongate bore 21 is an associated guide pin 22, which is fastened in a bore 23 of the first coaxial connector. The fastening of the guide pin 22 into the associated bore 23 is preferably effected by means of a screwed connection or a compression connection. For this purpose, the guide pin 22 has an external thread, which corresponds to the internal thread of the bore 23. The length of the guide pin 22 is designed such that, in the fastened state, i.e. in the screwed-in state, it reaches sufficiently far into the associated elongate bore 21 so as to ensure reliable guiding of the guide pin 22 in the elongate bore 21 as the coaxial cable 10 is being fixed into the coupler 100. In this way, a bayonet connection is realized between the locking device, in particular the first sleeve-type component 16 of the locking device, and the outer conductor 1 of the first coaxial connector, which bayonet connection exactly defines the axial movement of the locking device in relation to the outer conductor 1 of the first coaxial connector. Guide pin 22, e.g. by virtue of interaction with a respective elongate bore 21 may constitute a stop that limits motion of the locking device in an axial direction.

A spring 26 is clamped-in between the first end face 46 of a step 24 provided on the outer conductor 1 of the first coaxial connector and the opposite second end face 25 of the first sleeve-type component 16 of the locking device. The step 24 may be realized, as a shoulder, flange or ridge, radially outwardly on the outer conductor 1 of the first coaxial connector.

This spring 26 fixes the position of each guide pin 22, within the associated elongate bore 21, in the axial direction. For the purpose of better fixing the spring 26 between the first end face 46 of the outer conductor 1 of the first coaxial connector and the second end face 25 of the first sleeve-type component 16, the first sleeve-type component 16 has, on the end face, an annular groove 44, in which the spring 26 is seated.

The bayonet connection effects, not only an axial movement, but also a radial movement of the first sleeve-type component 16 in relation to the outer conductor 1 of the coaxial connector. Since, in the case of the locking device being supported on the conically realized outer cylindrical surface of the first spring sleeve 9, the radial movement of the first sleeve-type component 16 results in additional wear of the locking device and of the first spring sleeve 9, and is therefore unwanted, the locking device has the third sleeve-type component 18.

In a first preferred variant, this third sleeve-type component 18 is fixed, by means of at least one fixing component 27, in an associated recess 28 of the third sleeve-type component 18, and at the same time in an associated recess 29 in the radial extension 45 of the first spring sleeve 9. The third sleeve-type component 18 of the locking device is thereby fixed radially to the first spring sleeve 9. Preferably, as represented in FIG. 1C, two fixing components $\mathbf{27}_1$ and $\mathbf{27}_2$ are used, which are fixed in two recesses $\mathbf{28}_1$ and $\mathbf{28}_2$ of the third sleeve-type component 18 that are arranged with a 180° phase offset in each case, and in two recesses $\mathbf{29}_1$ and $\mathbf{29}_2$ of the radial extension 45 of the first spring sleeve 9 that are arranged with a 180° phase offset in each case.

The fixing component 27 is preferably a fixing pin having a round cross section. In addition, the fixing pin may also have other cross sections such as, for example, a square cross section or a hexagonal cross section. Also possible instead of a fixing pin, and covered by the invention, are components having a different geometry, for example ball-shaped fixing components.

The recess 28 in the third sleeve-type component 18 is preferably a bore, while the recess 29 in the radial extension 45 of the first spring sleeve 9 is preferably realized as a groove. In addition, the invention also covers other forms of the recess 28 and of the recess 29 that match the geometry of the fixing component 27.

The third sleeve-type component 18 of the locking device is preferably inserted between the outer cylindrical surface of the first spring sleeve 9, the radial extension 45 of the first spring sleeve 9, and the inner cylindrical surface of the first sleeve-type component 16 of the locking device.

Alternatively, in a second variant, the first spring sleeve 9 does not have a radial extension 45. In this case, the third sleeve-type component 18 of the locking device is inserted between the outer cylindrical surface of the first spring sleeve 9, the end face at the second end 8 of the outer conductor 1 of the first coaxial connector, and the inner cylindrical surface of the first sleeve-type component 16 of the locking device. In the second variant, the fixing components 27 are each seated in an associated recess, i.e. a bore or groove, on the end face at the second end 8 of the outer conductor 1 of the first coaxial connector, and in an associated recess 28 in the third sleeve-type component 18.

For the purpose of axially driving the third sleeve-type component 18 with the axial movement of the first sleeve-type component 16 as the coaxial cable 10 is being fixed into the coupler 100, the third sleeve-type component 18 has a radially outwardly directed extension 30. This radially outwardly directed extension 30 of the third sleeve-type component 18 is driven axially in the direction of the first coaxial connector by means of a radially inwardly directed extension 31 of the first sleeve-type component 16.

The radially outwardly directed extension 30 of the third sleeve-type component 18 and the radially inwardly directed extension 31 of the first sleeve-type component 16 are formed at such an axial position on the third sleeve-type component 18, and on the first sleeve-type component 16, respectively, that the radially outwardly directed extension 30 of the third sleeve-type component 18 is positioned closer to the first coaxial connector than is the radially inwardly directed extension 31 of the first sleeve-type component 16.

An annular component 32 is preferably arranged between the radially outwardly directed extension 30 of the third sleeve-type component 18 and the radially inwardly directed extension 31 of the first sleeve-type component 16.

The radially outwardly directed extension 30 of the third sleeve-type component 18 and the radially inwardly directed extension 31 of the first sleeve-type component 16 are in each case preferably realized as ridge, or flange, extending over the entire angular range of 360° of the third sleeve-type component 18, and of the first sleeve-type component 16, respectively.

The annular component 32 arranged between the radially inwardly directed extension 31 of the first sleeve-type component 16 and the radially outwardly directed extension 30 of the third sleeve-type component 18 is preferably made of a material that has a comparatively low coefficient of sliding friction. In this way, the radial movement of the first sleeve-type component 16 and the radial fixing of the third sleeve-type component 18 in relation to the first spring sleeve 9 result in a significantly lesser wear of the radially inwardly directed extension 31 of the first sleeve-type component 16 and of the radially outwardly directed extension 30 of the second sleeve-type component 18 than without interposition of the annular component 32.

In order for a continuously identical compression force to be exerted by the first spring sleeve 9 upon the shielding serving as an outer conductor 11 of the coaxial cable 10, even in the case of inaccuracies of the outer diameter of the shielding, belonging to the coaxial cable 10, that are due to the production process, the locking device additionally has a second sleeve-type component 17. This second sleeve-type component 17 is supported on the conically realized outer cylindrical surface at the distal end of the first spring sleeve 9. By its external thread located on the outer cylindrical surface, the second sleeve-type component 17 can be screwed into an associated internal thread on the inner cylindrical surface of the third sleeve-type component 18. In this way, the axial position of the second sleeve-type component 17 is adjusted in a comparatively accurate manner, in relation to the first spring sleeve 9, according to the existing external diameter of the shielding serving as an outer conductor 11 of the coaxial cable 10 to be measured, and a previously defined compression force, by the first spring sleeve 9 upon the shielding serving as an outer conductor 11 of the coaxial cable 10, is thereby set in the case of a coaxial cable 10 fixed in the coupler 100.

Provided in the locking device, for the purpose of axially positioning the second sleeve-type component 17 in a fixed manner in relation to the third sleeve-type component 18, there is a nut 19, which is screwed onto the external thread of the second sleeve-type component 17 and locked against the end face of the third sleeve-type component 18.

In order to reduce the force expended by the user of the measurement system in fixing the coaxial cable 10 to be examined in the coupler 100, the coupler 100 has at least one grip 33, preferably two grips 33, directed radially in relation to the longitudinal axis of the coupler 100. Each grip 33 is fastened in an associated bore 34 of the first sleeve-type component 16. The fastening is preferably effected by means of a screwed connection, as indicated in FIG. 1A.

Figure 1C:
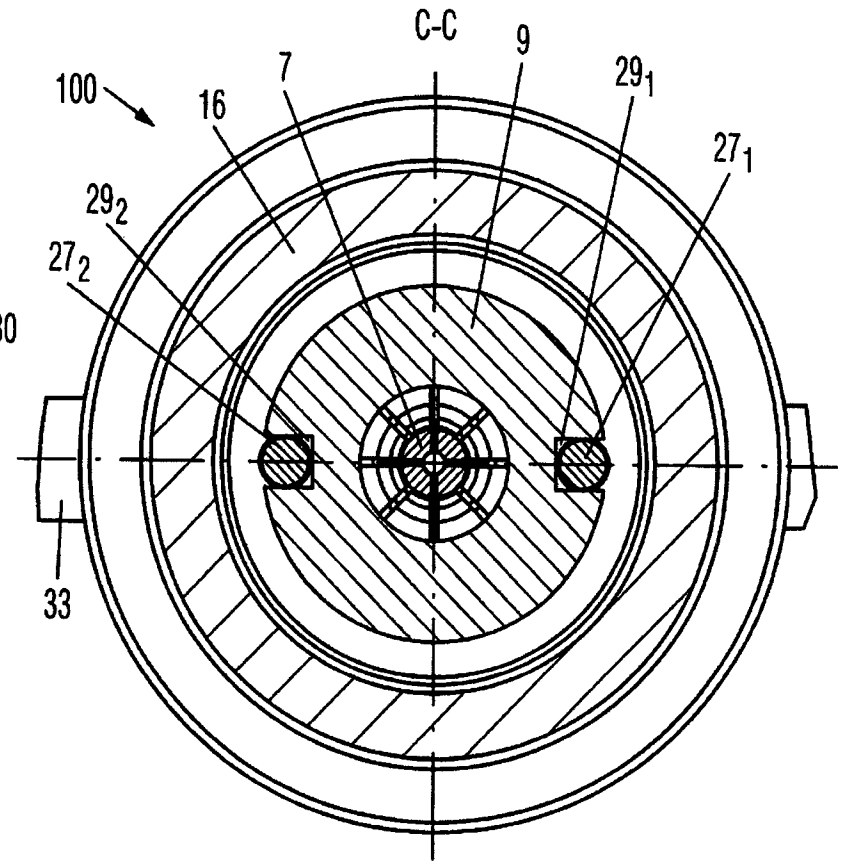
Figure 1B:
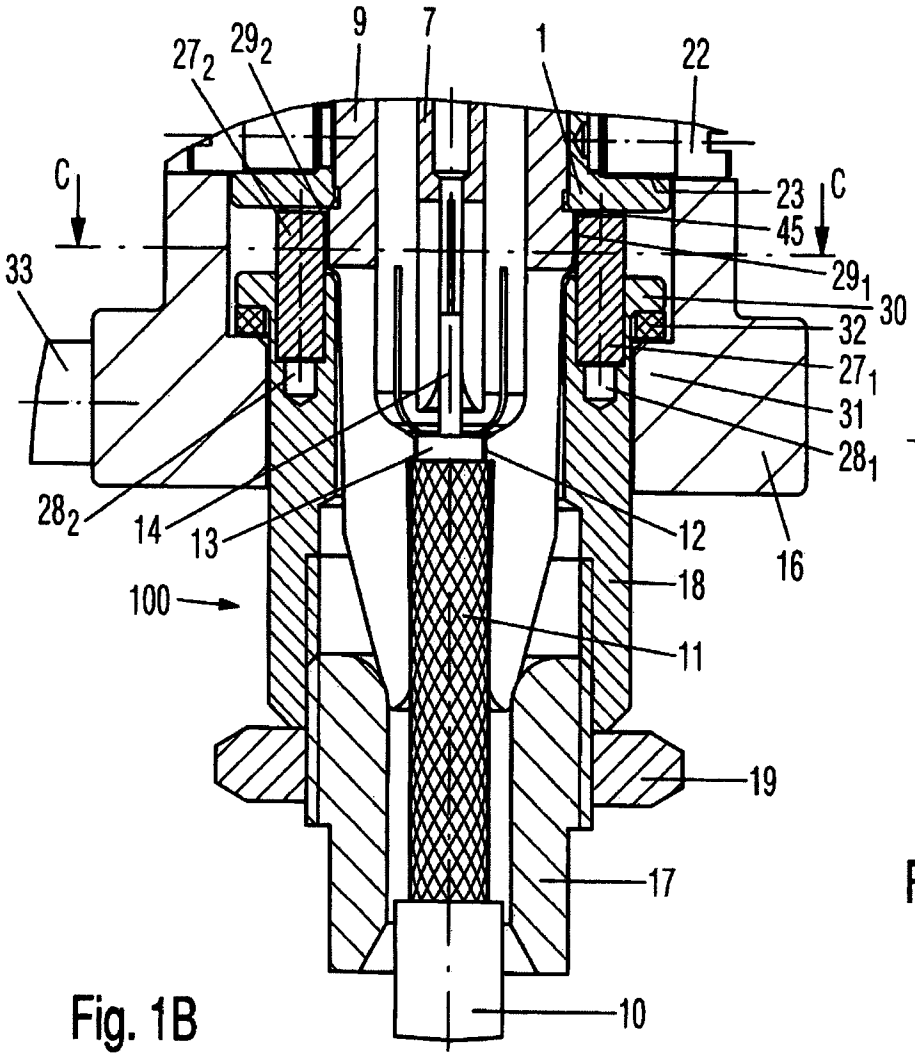

Whereas FIG. 1A comprises a combined representation of a side view and an axial cross section of the first embodiment 100 of the coupler in the case of a coaxial cable 10 that has been inserted in the first spring sleeve 9, but that has not yet been axially fixed in the coupler, FIG. 1B represents an axial cross section of the first embodiment 100 of the coupler in the case of a coaxial cable 10 axially fixed in the coupler.

FIG. 1C shows the radial cross section of the first embodiment 100 of the coupler in the case of a section through the section line C-C represented in FIG. 1B. FIG. 1C shows, in particular, the seating of the fixing components $\mathbf{27}_1$ and $\mathbf{27}_2$, each realized as fixing pins, in the associated recesses $\mathbf{29}_1$ and $\mathbf{29}_2$, each realized as grooves, in the radial extension 45 of the first spring sleeve 9.

Figure 2A:
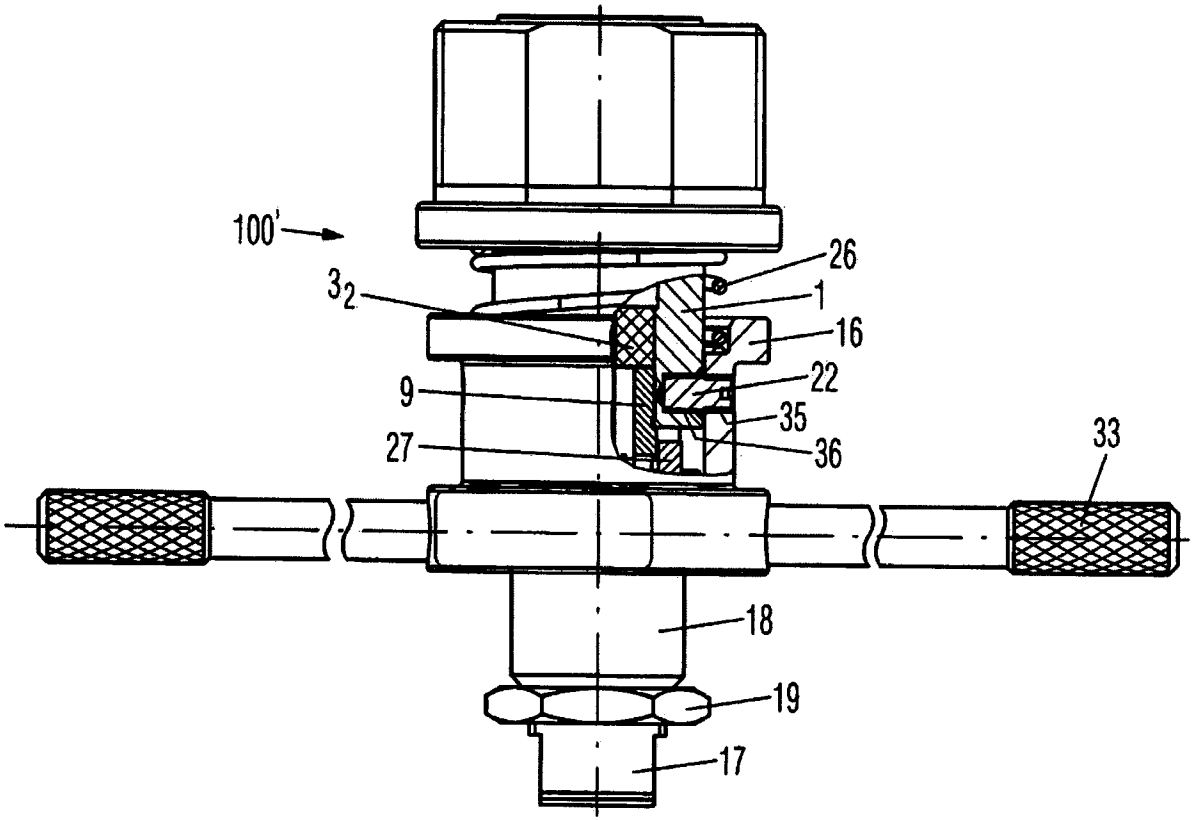
Figure 2B:
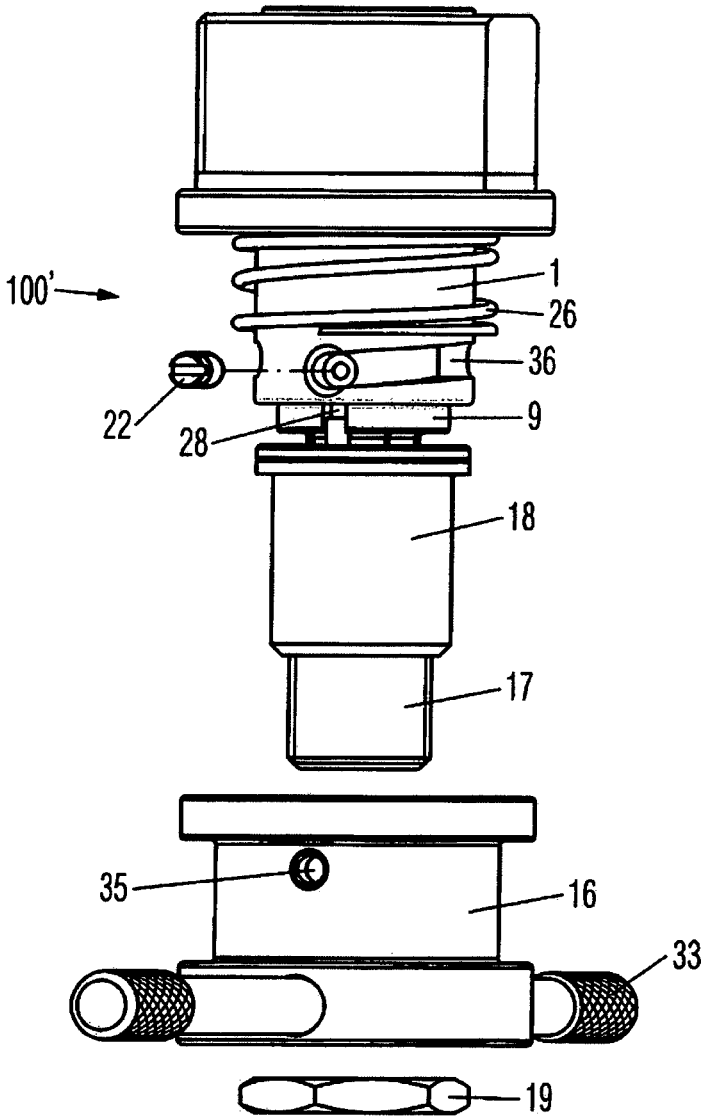

FIGS. 2A and 2B show a second embodiment 100' of the coupler, wherein the same references denote parts that are functionally the same as in FIGS. 1A, 1B and 1C, in which a first embodiment 100 of the coupler is represented in each case, such that reference is made to the above description of FIGS. 1A, 1B and 1C for explanation of these parts.

In the second embodiment 100' of the coupler, the bayonet connection between the outer conductor 1 of the first coaxial connector and the first sleeve-type component 16 of the locking device is realized in that at least one guide pin 22 is fastened in an associated bore 35 in the first sleeve-type component 16 of the locking device, and is guided in an associated elongate bore 36 in the outer conductor 1 of the first coaxial connector. The fastening of each guide pin 22 in the associated bore 35 in the first sleeve-type component 16 is preferably effected by a screwed connection. Preferably also provided in the second embodiment 100' of the coupler are two elongate bores 36, in each of which a guide pin 22 is guided. Alternatively, in the second embodiment 100' of the coupler, any technically appropriate number of the combination of elongate bores 36 and associated guide pins 22 may be realized. Guide pin(s) 22, e.g. by virtue of interaction with a respective elongate bore 36, may constitute a stop that limits motion of the locking device in an axial direction.

Figure 3:
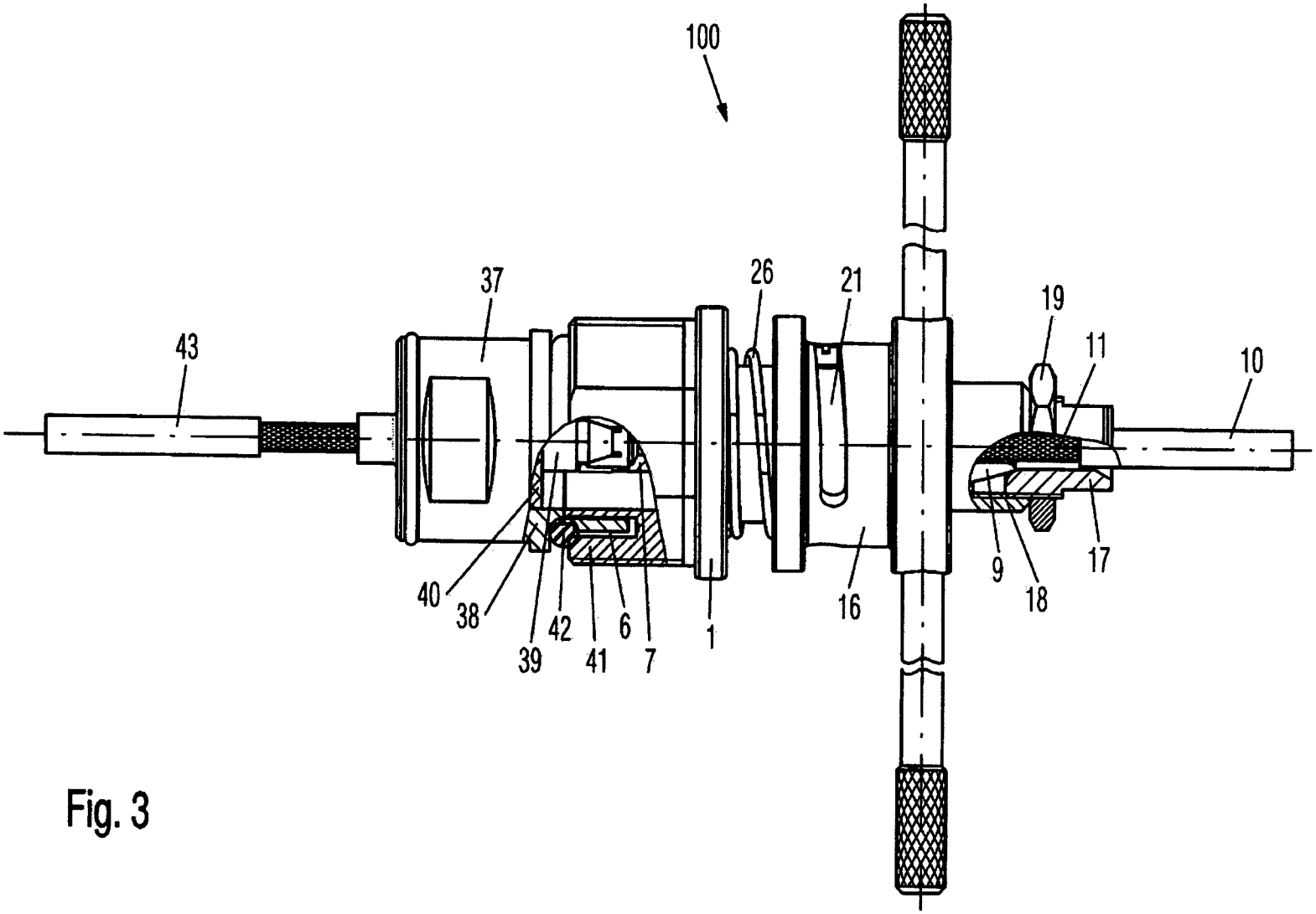

FIG. 3 shows a representation of a first embodiment 100 of the coupler in accordance with the invention in which the first coaxial connector is connected to a second coaxial connector 37 and forms a plug-and-socket connector.

In FIG. 3, the same references denote parts that are functionally the same as in FIGS. 1A, 1B and 1C, such that, for explanation thereof, reference is made to the above description of FIGS. 1A, 1B and 1C.

The second coaxial connector 37 has an outer conductor 38 realized substantially as a hollow cylinder, and an inner conductor 39 realized substantially as a cylinder. There is an insulator part 40 inserted between the outer conductor 38 and the inner conductor 39 of the second coaxial connector 37.

When the plug-and-socket connector is in the connected state, the substantially sleeve-type end of the outer conductor 38 belonging to the second coaxial connector 37 is inserted in a hollow-cylinder groove 6 at the first end 4 of the outer conductor 1 belonging to the first coaxial connector. The sleeve-type end of the outer conductor 38 belonging to the second coaxial connector 37 is connected in a force-fitting manner, in particular by its inner cylindrical surface, to the inside cylindrical surface of the hollow-cylinder groove 6 belonging to the first coaxial connector.

When the plug-and-socket connector is in the connected state, the inner conductor 39 of the second coaxial connector 37 is plugged-in, in a force-fitting and form-fitting manner, in the third spring sleeve 7 at the first end 4 of the inner conductor 2 belonging to the first coaxial connector.

For additional mechanical fixing of the plug-and-socket connector, passed over the outer conductor 38 of the second coaxial connector there is a cap nut 41, the internal thread of which realizes a screwed connection with an external thread 5 provided on the outer cylindrical surface of the outer conductor 1 of the first coaxial connector.

There is a sealing ring 42, for example an O-ring, inserted in a groove provided on the outer cylindrical surface of the outer conductor 38 belonging to the second coaxial connector 37, preferably in a corner between the outer cylindrical surface and an adjoining end face of the outer conductor 38. This sealing ring 42 is pressed against an edge that is located between the outside cylindrical surface in the hollow cylindrical groove 6, provided at the first end 4 of the outer conductor 1 of the first coaxial connector, and the adjoining end face. A functional sealing of the plug-and-socket connector against ingress of moisture is thereby realized.

Finally, the high-frequency measurement cable 43, which is connected to an interface of the measuring device, for example a vectorial network analyzer, is electrically and mechanically contacted, in the usual technical manner, to the second coaxial connector 37.

In industrial practice, not only conventional coaxial cables, having a shielding that serves as an outer conductor 11 and having an insulating cable sheath, but also so-called rigid coaxial cables, and, in cable assembly, also semi-rigid coaxial cables, each having a metallic tube as an outer conductor 11 of the coaxial cable 10 instead of the shielding, and without insulating cable sheaths, are measured in respect of their transmission characteristic. The termination of such semi-rigid coaxial cables to the coupler is also covered by the invention. In this case, the metallic tube of the outer conductor belonging to the semi-rigid coaxial cable is clamped-in within the inner cylindrical surface of the first spring sleeve 9 and, with its end face, comes against the radially inwardly directed ridge 12 of the first spring sleeve 9.

By the invention is not limited to the embodiments and variants of the coupler described in the disclosure. The invention also covers, in particular, all combinations of the features respectively claimed in the individual claims, of the features respectively disclosed in the description, and of the features respectively represented in the individual figures of the drawing, insofar as they are technically appropriate.

The invention claimed is:

1. An electrical connector, comprising:
an outer conductor;
an inner conductor coaxial to said outer conductor;
a locking device movably arranged on said outer conductor; and
a stop mounted to said outer conductor, wherein
a contact portion of said outer conductor is resiliently compressible in a radially inward direction,
said stop limits a motion of said locking device in an axial direction relative to said outer conductor,
said locking device, in a fully engaged state of said locking device and said stop, precisely defines a distance between said stop and a contact point of said locking device and said outer conductor, and
an axial position of said locking device relative to said outer conductor definitively defines a diameter of said contact portion at a free end of said contact portion.

2. The electrical connector of claim 1, wherein:
said motion of said locking device in said axial direction relative to said outer conductor alters an amount of compression of said contact portion in said radially inward direction.

3. The electrical connector of claim 1, wherein:
said contact portion comprises a tapered outer surface, and
said locking device abuts said tapered outer surface.

4. The electrical connector of claim 3, wherein:
said tapered outer surface decreases in diameter with decreasing distance to said free end.

5. The electrical connector of claim 1, wherein:
said contact portion defines a generally tubular hollow that receives a coaxial cable such that said contact portion presses an outer conductor of said coaxial cable directly against a component of said coaxial cable radially inward of said outer conductor.

6. The electrical connector of claim 1, wherein:
said locking device is engageable to said stop in a manner that inhibits motion of said locking device relative to said outer conductor in said axial direction and that inhibits motion of said locking device relative to said outer conductor in a direction opposite said axial direction.

7. The electrical connector of claim 1, wherein:
said locking device forms a first portion of a bayonet connection, and
said stop forms a second portion of said bayonet connection that engages said first portion.

8. An electrical connector, comprising:
an outer conductor;
an inner conductor coaxial to said outer conductor;
a locking device; and
a stop, wherein
a contact portion of said outer conductor is resiliently compressible in a radially inward direction,
said locking device comprises an engagement portion and a clamping portion adjustably positionable relative to said engagement portion,
said engagement portion engages said stop such that said stop limits a motion of
said locking device in an axial direction relative to said outer conductor, and
a position of said clamping portion relative to said outer conductor definitively defines a diameter of said contact portion at a free end of said contact portion.

9. The electrical connector of claim 8, wherein:
a position of said clamping portion relative to said engagement portion is manually adjustable.

10. The electrical connector of claim 8, wherein:
said locking device comprises an intermediate portion that interconnects said engagement portion and said clamping portion,
said clamping portion threadingly engages said intermediate portion.

11. The electrical connector of claim 8, comprising:
a counter-nut that inhibits rotation of a thread of said clamping portion relative to a thread of said intermediate portion.

12. The electrical connector of claim 8, wherein:
said contact portion comprises a tapered outer surface, and
said clamping portion abuts said tapered outer surface.

13. The electrical connector of claim 8, wherein:
said tapered outer surface decreases in diameter with decreasing distance to said free end.

14. The electrical connector of claim 8, wherein:
said contact portion defines a generally tubular hollow.

15. The electrical connector of claim 8, wherein:
said engagement portion forms a first portion of a bayonet connection, and
said stop forms a second portion of said bayonet connection that engages said first portion.

16. The electrical connector of claim 15, wherein:
said stop is generally peg-shaped, and said engagement portion comprises an elongate opening that engages said stop.

17. An electrical connector, comprising:

an outer conductor;

an inner conductor coaxial to said outer conductor;

a locking device; and a stop, wherein a contact portion of said outer conductor is resiliently compressible in a radially inward direction, said locking device comprises an engagement portion, a clamping portion and an intermediate portion that interconnects said engagement portion and said clamping portion, said engagement portion engages said stop such that said stop limits a motion of said locking device in an axial direction relative to said outer conductor, a position of said clamping portion relative to said outer conductor definitively defines a diameter of said contact portion at a free end of said contact portion, said intermediate portion engages said outer conductor in a manner than inhibits rotation of said intermediate portion relative to said outer conductor, said engagement portion is rotatable relative to said intermediate portion.

18. The electrical connector of claim 17, wherein:

a position of said clamping portion relative to said engagement portion is manually adjustable.

19. The electrical connector of claim 17, wherein:

said clamping portion threadingly engages said intermediate portion.

20. The electrical connector of claim 19, comprising:

a counter-nut that inhibits rotation of a thread of said clamping portion relative to a thread of said intermediate portion.

21. The electrical connector of claim 17, comprising:

said engagement portion forms a first portion of a bayonet connection, and said stop forms a second portion of said bayonet connection that engages said first portion.

* * * * *